US006948960B1

(12) United States Patent
Chen

(10) Patent No.: US 6,948,960 B1
(45) Date of Patent: Sep. 27, 2005

(54) ELECTRICAL CARD CONNECTOR

(75) Inventor: Chiu-Kuei Chen, Hsinchuang (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 10/972,385

(22) Filed: Oct. 26, 2004

(51) Int. Cl.[7] ..... H01R 13/62
(52) U.S. Cl. ..... 439/159; 439/609
(58) Field of Search ..... 439/155–159, 439/607–609

(56) References Cited

U.S. PATENT DOCUMENTS 6,592,385 B1 * 7/2003 Chen ..... 439/159
6,746,256 B1 * 6/2004 Wang ..... 439/159
6,767,232 B1 * 7/2004 Tien ..... 439/159

* cited by examiner

*Primary Examiner*—Truc Nguyen
(74) *Attorney, Agent, or Firm*—Rosenberg, Klein & Lee

(57) ABSTRACT

The present invention is related to an electrical card connector, in which a shielding member introduced therein includes a latch, and an against portion using for abutting against a guide rod of an ejector and a top of a fixing end of the guide rod respectively so as to limit upward displacement of the guide rod. This configuration can prevent the guide rod from shaking vertically; thereby the guide rod is fixed in a stable manner. Moreover, a guide groove of the slide rod mates with a guide rib of the insulating housing so as to make the slider slide on the insulating housing stable. Thereby, electrical cards can be inserted or ejected stably and smoothly.

12 Claims, 6 Drawing Sheets

ELECTRICAL CARD CONNECTOR

BACKGROUND OF THE INVENTION

1. Field of the Invention

The present invention relates to an electrical card connector, and particularly to an electrical card connector mounted on a Print Circuit Board (PCB) for retaining an electrical card therein.

2. Description of Related Art

Recently, electrical cards have become widely used in the field of electronic appliances. As such, electrical card connectors are now adapted to connect electrical cards to appliances in which the electrical card connectors are mounted on the PCB of the appliance and retain electrical cards therein, allowing data to be transferred there between.

Referring to FIG. 1, a conventional electrical card connector is shown, which includes an insulating housing 1, a plurality of conductive terminals 2, and an ejector 3. The insulating housing 1 has a base portion 11, a first side arm 12 and a second side arm 13 extending parallel from two ends of the base portion 11 respectively so as to form a receiving cavity 14 for retaining an electrical card 4.

The conductive terminals 2 are arranged in the base portion 11 of the insulating housing 1. Each of the conductive terminals 2 includes a soldering portion extending from a bottom portion of the insulating housing 1 for connecting electrically with a PCB (not shown), and a contact portion extending through to the receiving cavity 14 for connecting electrically to the electrical card 4 introduced therein.

The ejector includes a slider 31, a spring 32, and a guide rod 33 fixed to the slider 31, in which, the slider 31 can slide forwards and backwards on the insulating housing 1. The insulating housing has a slide groove 34 therein, and one end (not labeled) of the guide rod 33 slides to mate with the slide groove 34. The end of the guide rod 33 has two sliding tracks which slide in the slide groove 34.

When inserting or ejecting, the electrical card 4 is pushed forward so that the electrical card 4 pushes the slider 31. Then the electrical card 4 can be inserted or ejected by making the guide rod 33 slide along the slide groove 34.

However, due to the configuration of the conventional electrical card connector, the slider 31 is likely to shake vertically while sliding along the slide groove 34, thereby the slider 31 cannot engage with the insulating housing 1 stably. It is likely that this configuration becomes flexible while the shaking is enhanced, impacting upon the operation of the ejector 3 and the whole electrical card connector.

Moreover, the slider 31 is slideably disposed on the insulating housing 1, the slider 31 is likely to shake while being pushed forwards or backwards. Thereby, the electrical card 4 cannot be inserted or ejected smoothly or connected electrically to the electrical card connector reliably.

Furthermore, when the electrical card 4 is inserted into the receiving cavity 14, the electrical card is not fixed to the electrical card connector stably. Thereby, the electrical card cannot reliably connect electrically to the electrical card connector.

In addition, a front portion of the first side arm 12 and the second side arm 13 of the insulating housing 1 are formed as a free end. Then the first and second side arms 12 and 13 are likely to expand and distort when the electrical card 4 is inserted or ejected.

It is desirable to provide an improved electrical card connector for containing electrical cards that overcomes the above problems.

SUMMARY OF THE INVENTION

An objective of the present invention is to provide an electrical card connector, which limits the upward displacement of the guide rod, and prevents the guide rod from shakingvertically, thus ensuring that the electrical card connector has a reliable configuration.

Another objective of the present invention is to provide an electrical card connector, which makes the slider slide on the insulating housing stably thus ensuring that the electrical card slides forwards and backwards smoothly.

Another objective of the present invention is to provide an electrical card connector, which ensures a reliable electronic connection with the electrical card.

Another objective of the present invention is to provide an electrical card connector which has a stable configuration.

In order to achieve the objectives set forth, an electrical card connector in accordance with the present invention includes an insulating housing having a receiving cavity, the insulating housing comprises a guide rib; a plurality of conductive terminals being retained in the insulating housing; an ejector having a slider, a spring, and a guide rod, the slider slideably mates with the insulating housing by moving forwards or backwards, the slider has a slide groove therein, and a guide groove in a bottom portion thereof, the guide groove slideably engages with the guide rib, the spring is introduced between the insulating housing and the slider, one end of the guide rod is fixed to the insulating housing, and the other end is movably mated with the slide groove; a shielding member is mounted on the insulating housing, the shielding member has a latch and against point for abutting against the guide rod and a top portion of the first end of the guide rod, respectively.

Other objects, advantages, and novel features of the present invention will became more apparent from the following detailed description when taken in conjunction with the accompanying drawings.

DETAILED DESCRIPTION OF PREFERRED EMBODIMENTS

Figure 1:
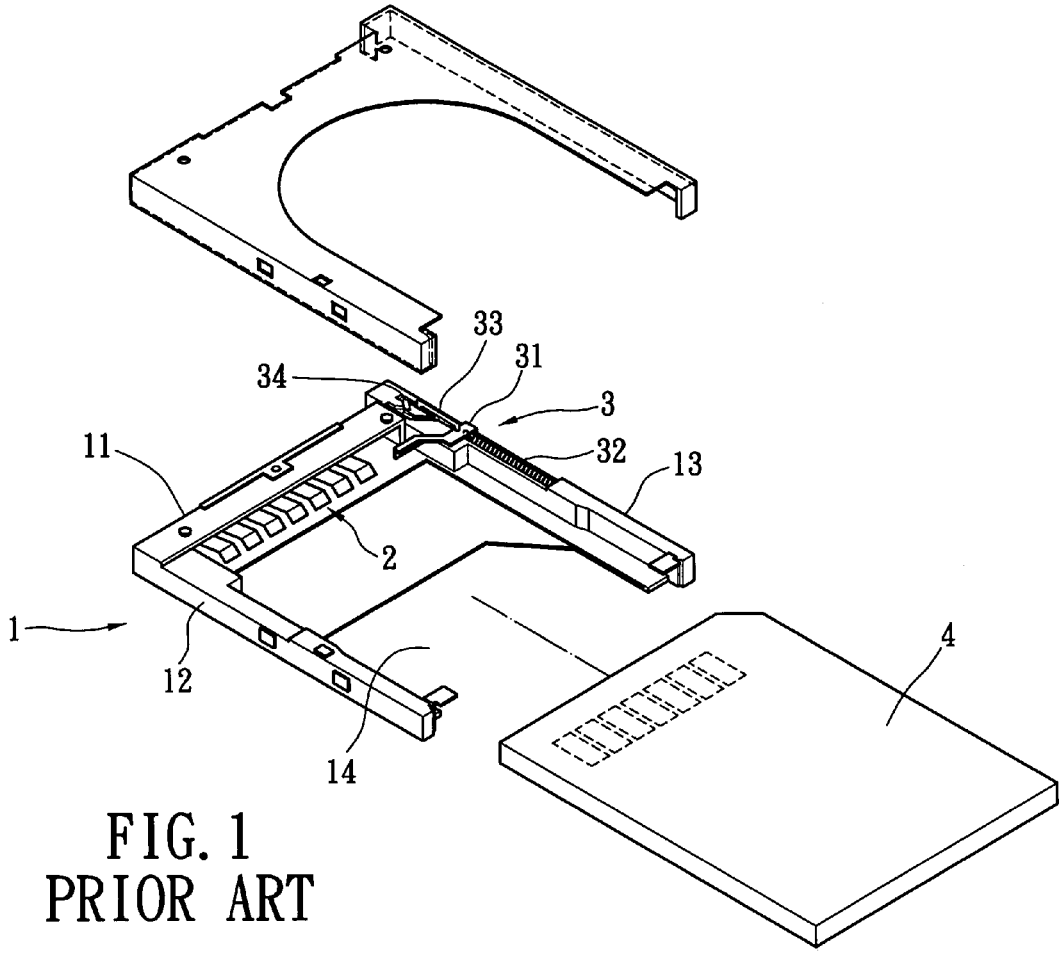
FIG. 1 PRIOR ART
FIG. 1 is a perspective view of a conventional electrical card connector.
Figure 2:
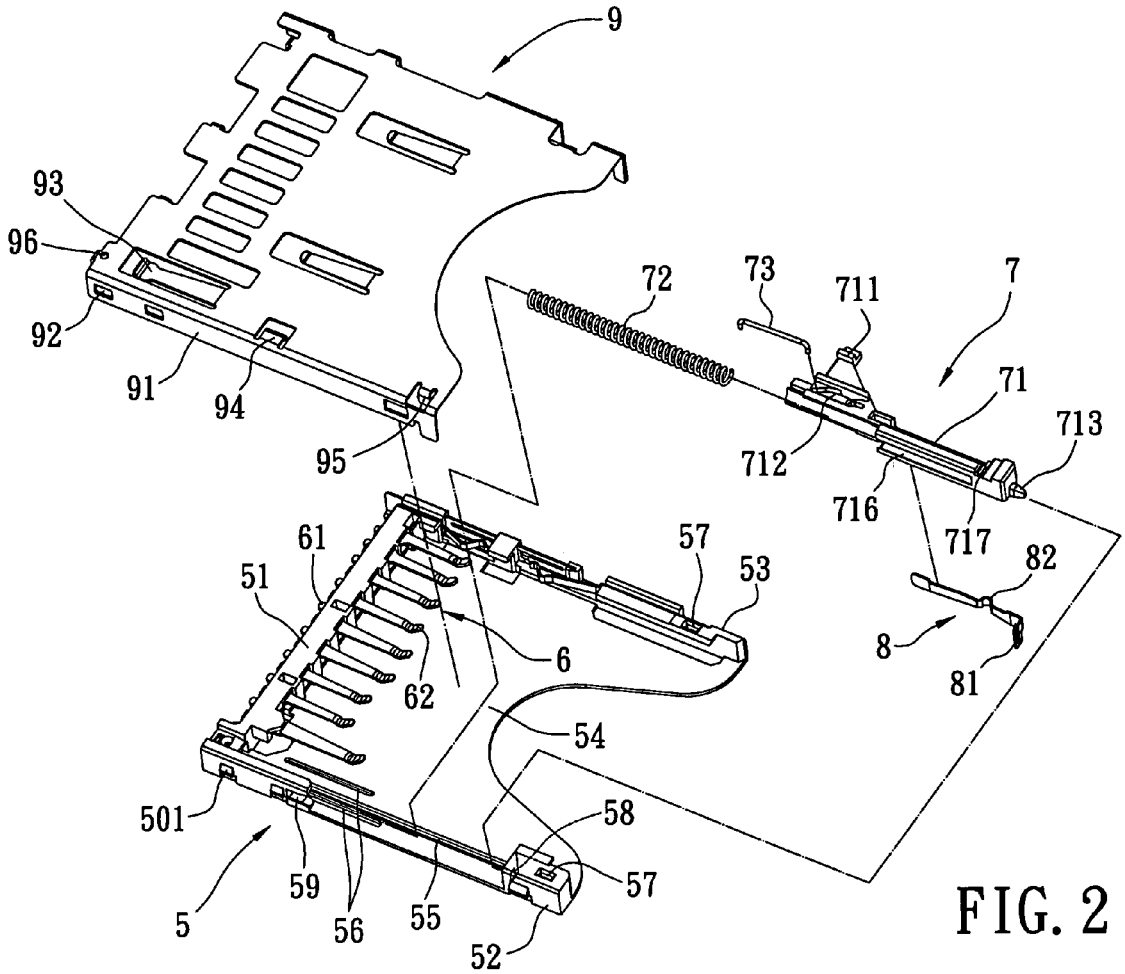
FIG. 2 is an exploded, perspective view of an electrical card connector according to the present invention.
Figure 3:
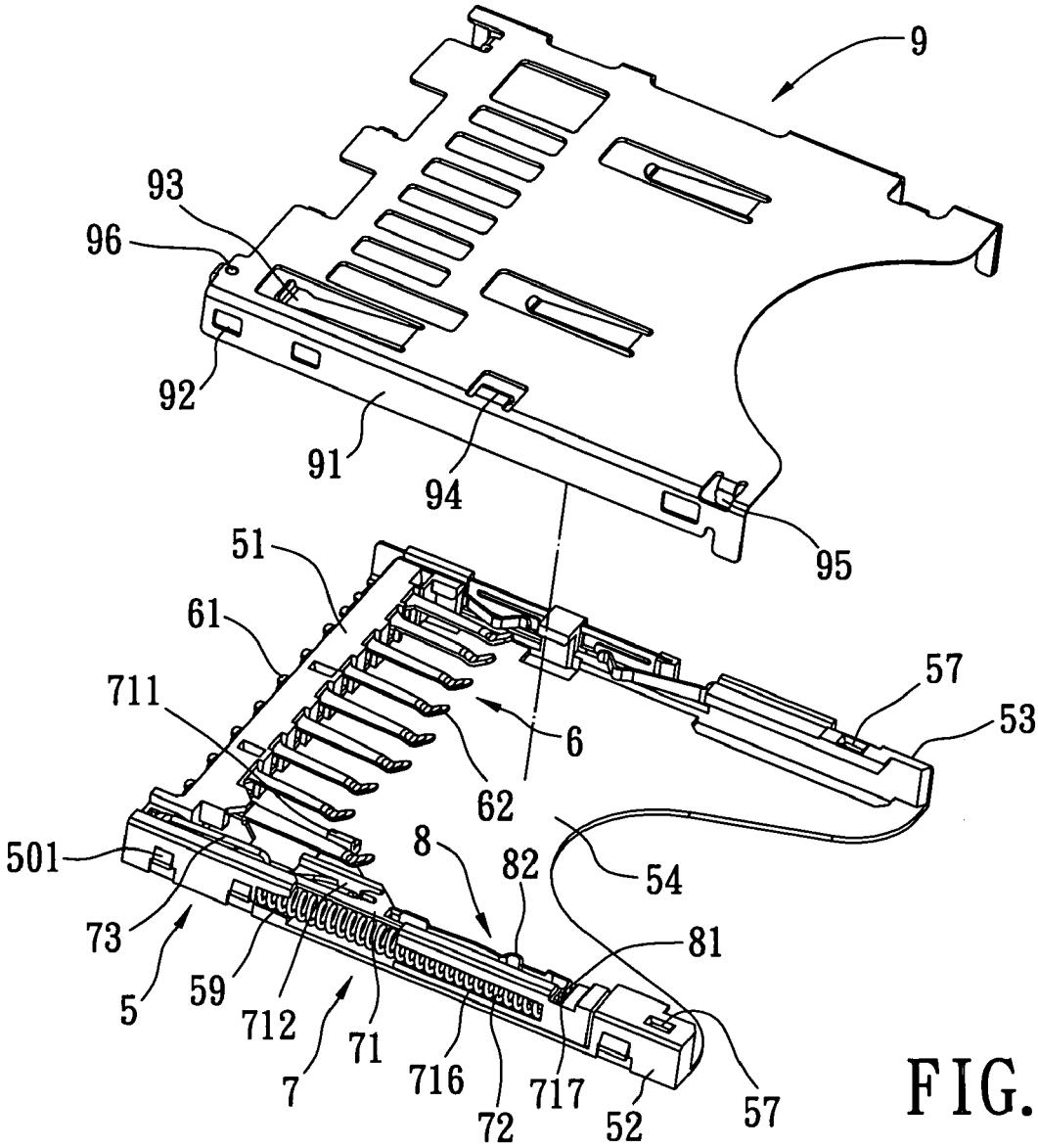
FIG. 3 is an assembled view of FIG. 2, in which a shielding member is not attached thereto.
Figure 4:
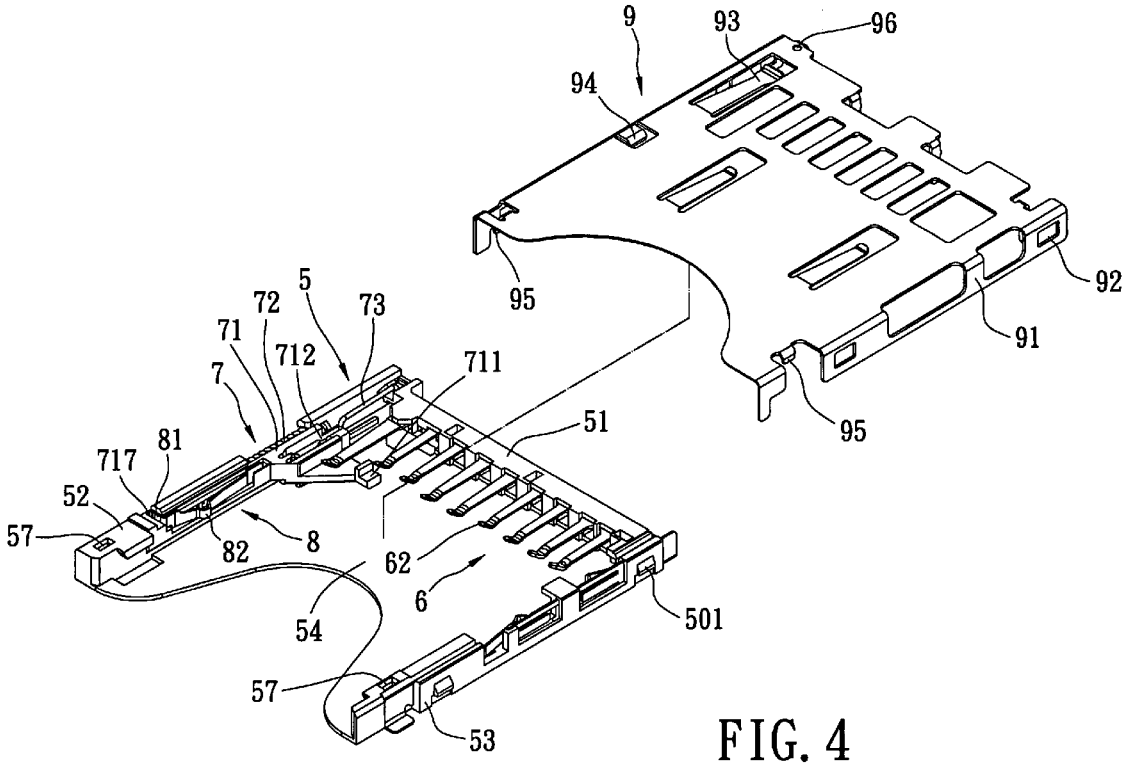
FIG. 4 is an assembled view of FIG. 2, in which a shielding member is not attached thereto, and shown in another viewing angle.

Referring to FIGS. 2–4, an electrical card connector used for receiving or ejecting an electrical card in accordance with the present invention is shown. The electrical card connector comprises an insulating housing 5, a plurality of conductive terminals, an ejector 7, a spring switch 8, and a shielding member 9. The insulating housing 5 is made of a plastic material, which includes a base portion 51, a first side arm 52 and a second side arm 53 extending parallel from the two ends of the base portion 51. They can also be convex. The base portion 51, the first side arm 52, and the second side arm 53 form a receiving cavity 54 therebetween for retaining electrical cards. The insulating housing 5 has a guide rib 55 adjacent to the first side arm 52, and two longitudinal slots 56 disposed at opposite sides of the guide rib 55 respectively. The guide rib 55 and the longitudinal slots 56 extend along a direction that is relative to inserting or ejecting electrical cards. The first side arm 52 and the second side arm 53 have engaging holes, which are formed on a top of the side arms 52 and 53 adjacent to a front end thereof.

The conductive terminals 6 are made of a conductive elastic metal material, which are alternately located on the base portion 51 of the insulating housing 5 and extend along the same direction as an electrical card when it is inserted or ejected. Each of the conductive terminals 6 include a soldering portion 61 extending from a bottom portion of the insulating housing 1 for connecting electrically to a PCB (not shown), and a contact portion 62 extending through into the receiving cavity 54 for connecting electrically to the electrical cars introduced therein.

Figure 6:
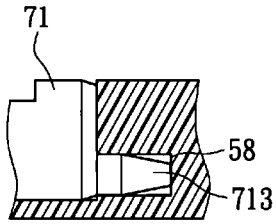
FIG. 6 is an isometric, assembled view of the present invention, in which a protrusion of the slider is mating with a groove of an insulating housing.

The ejector 7 is engaged with the insulating housing 5. The ejector 7 includes a slider 71, a spring 72, and a guide rod 73. The slider 71 slides forwards or backwards and mates with the first side arm 52 of the insulating housing 5 along a front-to-back direction. The slider 71 has a push button 711 extending from an inner side thereon and extending through into the receiving cavity 54 for abutting against the electrical card in order to push the slider 7. The slider 71 includes a slider groove 712 formed on a top portion thereof for controlling the sliding track of the slider 71. The slider 71 has a protrusion 713 formed at a front end thereof, and the insulating housing 5 has a groove 58 corresponding to the protrusion 713 for retaining the protrusion 713 (shown in FIG. 6). This configuration guides the slider 71 forwards and backwards stably.

Figure 5:
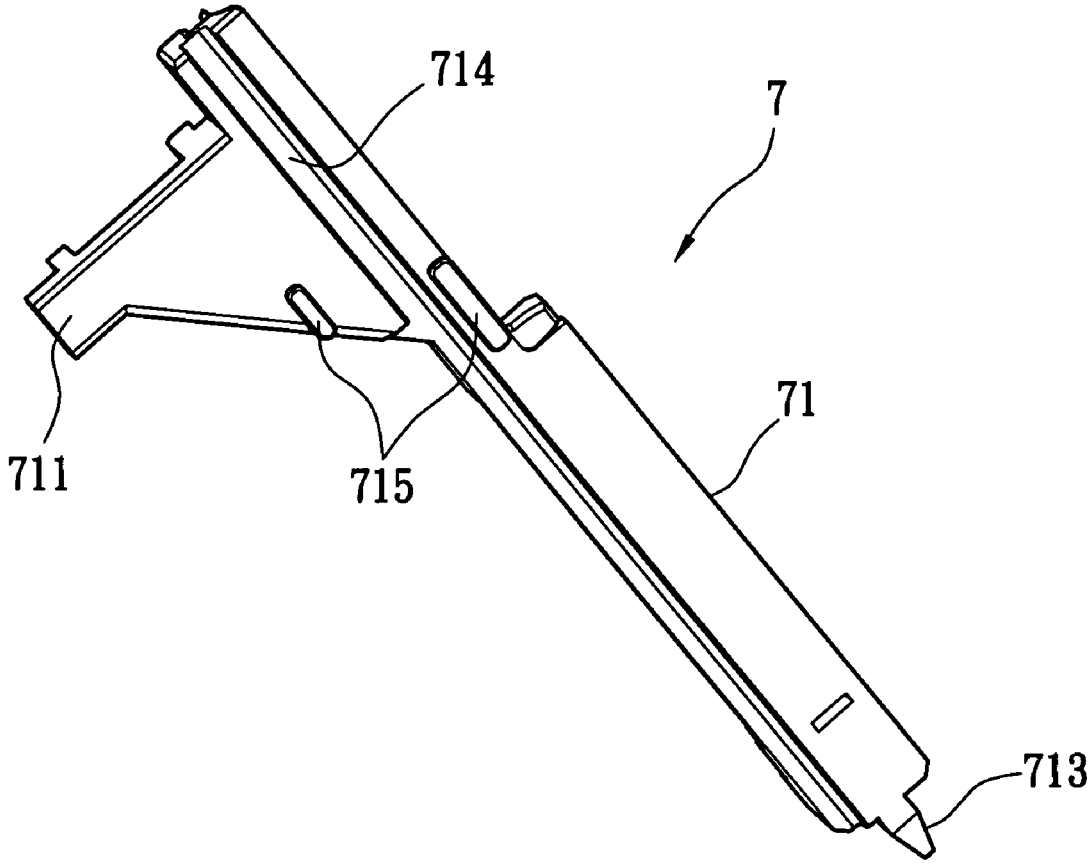
FIG. 5 is a perspective view of a slider of the electrical card connector in accordance with the present invention.
Figure 7:
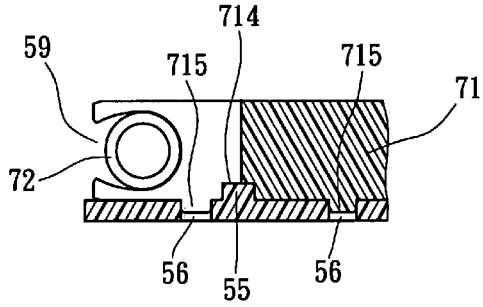
FIG. 7 is an isometric, assembled view of the present invention, in which a guide groove of the slider is mating with a guide rib of the insulating housing.
Figure 8:
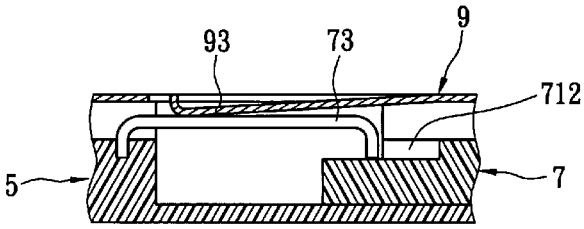
FIG. 8 is an isometric view of the present invention, in which a latch is abutting against a top margin of a guide rod.

Moreover, the slider 71 has a guide groove 714 (shown in FIG. 5 and FIG. 7) formed on the bottom thereof, which corresponds to the guide rib 55. Two protruding blocks 715 are disposed at both sides adjacent to the guide groove 714 corresponding to the longitudinal slots 56 respectively. The guide groove 714 and the protruding block 715 mate with the corresponding guide rib 55 and longitudinal slot 56 respectively so as to guide the slider 71 onto the insulating housing 5 stably.

Two ends of the spring 72 are retained and abutted against a retaining groove 716 of the slider 71 and a recess 59 of the first side arm 52 of the insulating housing 5 respectively. The spring 72 is arranged between the slider 71 and the insulating housing 5 in order to provide the force of the compressed spring 72.

The guide rod 73 has a first free end fixed to the insulating housing 5, and a second free end that movably mates with the slide groove 712. The guide rod 73 has two sliding tracks which slide in the slide groove 712 so as to form a mechanism to control the insertion or ejection of electrical cards.

The spring switching 8 is made of an elastic metal material, which is L-shaped. The spring switching 8 has a fixing portion 81 and a contact portion 82, in which the fixing portion 81 is engaged in an engaging groove 717 of the slider 71 so as to fix the spring switching 8 to the slider 71. The contact portion 82 extends from the fixing portion 81 and extends through into the receiving cavity 54. The contact portion 82 has a free end, and the free end can move elastically.

The shielding member 9 is made of a metal material, which is mounted on the insulating housing 5. The shielding member has two side edges 91 extending from ends thereof respectively, and each of the side edges 91 includes a plurality of mating holes 92. The insulating housing 5 further includes a plurality fastener 501 disposed outside both of the first and second side arms 52 and 53 corresponding to the mating holes 92. The mating holes 92 fasten with the fastener 501 respectively so as to assemble the shielding member 9 and the insulating housing 5.

Figure 9:
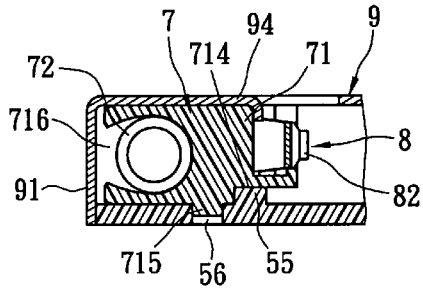
FIG. 9 is an isometric view of the present invention, in which a tab is abutting against a top margin of the slider.

The shielding member 9 has a latch 93 and an against point 96 disposed on a top portion corresponding to the guide rod 73. The latch 93 has a free end, which extends down into an inner side of the shielding member 9. After assembly, the latch 93 abuts against the top portion of the guide rod 73 (shown in FIG. 9). The against point 96 extends down so as to abut against the top portion of the guide rod 73 for limiting an upward or horizontal displacement thereof.

The shielding member 9 also has an L-shaped tab 94 disposed above the slider 71. The tap 94 can elastically compresses the top portion of the slider 71 (shown in FIG. 9) for limiting an upward or horizontal displacement thereof.

The shielding member 9 further comprises two engaging tabs 95 extending down into an inner side of the shielding member 9 and engaging with the corresponding engaging hole 57 of the first and second side arms 52 and 53 so as to fully assemble the electrical card connector.

An electrical card (not shown) is inserted by pushing it forward into the receiving cavity 54. The electrical card then compresses the push button 711 so as to push the slider 71. Meanwhile, the guide rod 73 slides into the slide groove 712 so as to retain the electrical card. After that, the conductive portion of the electrical card is connected electrically to the PCB of the electrical card connector by connecting to the contact portions 62 of the conductive terminals 6.

The electrical card is ejected by being pushed towards the insertion direction, the electrical card compresses the push button 711 and pushes the slider 71. The guide rod 73 moves out of the guide groove 712, and the slider 71 disengages the electrical card due to the force of the compressed spring switching 8.

According to the foregoing description, compared with the conventional electrical card connector, the electrical card connector according to the present invention has the following advantages.

First, the shielding member 9 introduced therein includes a latch 93, and an against portion 96 used for abutting against a guide rod 73 of an ejector 7 and a top of a fixing end of the guide rod 73 respectively so as to limit upward displacement of the guide rod 73. This configuration can prevent the guide rod 73 from shakingvertically. Thereby the guide rod 73 is fixed in a stable manner.

Second, the guide rod 73 further includes a protrusion 713 slideably mating with a corresponding groove 58 of the insulating housing 5, which makes the slider 71 slide along a front-to-back direction reliably. Moreover, the guide groove 714 of the slide rod 73 is mated with the guide rib 55 of the insulating housing 5 so as to make the slider 71 slide on the insulating housing 5 stably. The electrical cards can be inserted or ejected stably and smoothly.

Third, the contact portion 82 of the spring switching 8 abuts against the electrical card so as to fix the electrical card reliably. Thereby the electrical card is fixed in a stable manner.

Fourth, the shielding member 9 introduced therein includes a tab 94, for abutting against a top of the guide rod 73 so as to limit an upward displacement of the guide rod 73. Moreover, the guide groove 714 of the slide rod 73 is mated with the guide rib 55 of the insulating housing 5 so as to make the slider 71 slide on the insulating housing 5 stably. This configuration can prevent the guide rod 73 from shaking vertically. Thereby the electrical card can be pushed stably and smoothly according to the guide rod 73.

Fifth, the shielding member has two engaging tabs thereon, which engage with the latching holes 57 of the side arms 52 and 53. This assembly makes the electrical card connector have a stable configuration so as to prevent the side arms 52 and 53 from expanding or distorting while inserting or ejecting an electrical card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector, comprising:

an insulating housing having a receiving cavity, the insulating housing comprises a guide rib;

a plurality of conductive terminals being retained in the insulating housing;

an ejector having a slider, a spring, and a guide rod, the slider slideably mating with the insulating housing along a predetermined direction, the slider has a slide groove therein, and a guide groove in a bottom portion thereof, the guide groove slideably engaging with the guide rib, the spring is introduced between the insulating housing and the slider, a first end of the guide rod fixing to the insulating housing, and a second end of the guide rod is movably mated with the slide groove; and a shielding member mounted on the insulating housing, the shielding member has a latch and against point for abutting against the guide rod and a top portion of the first end of the guide rod, respectively.

2. The electrical card connector as claimed in claim 1, wherein the insulating housing further comprises a base portion, a first side arm and a second side arm, the first side arm and the second side arm connecting with ends of the base portion respectively so as to form a receiving cavity therebetween.

3. The electrical card connector as claimed in claim 2, wherein the first side arm and the second side arm comprise an engaging hole disposed at a front portion thereof respectively, the shielding member further having two engaging tabs that inserting into the corresponding engaging holes.

4. The electrical card connector as claimed in claim 1, wherein the insulating housing further comprises two slots disposed at both sides of the guide rib respectively, the slider further having two protruding blocks disposed at both sides of the guide groove, the protruding blocks slideably mating with the slots respectively.

5. The electrical card connector as claimed in claim 1, wherein each of the conductive terminals includes a soldering portion extending from the insulating housing, and a contact portion extending through to the receiving cavity.

6. The electrical card connector as claimed in claim 1, wherein the slider further includes a push button extending from an inner side thereof, the push button inserted into the receiving cavity.

7. The electrical card connector as claimed in claim 1, wherein the slider has a protrusion thereof, the protrusion slideably engaged with the groove.

8. The electrical card connector as claimed in claim 1, wherein the shielding member further comprises two side edges extending from ends thereof respectively, each of the side edges include a plurality of mating holes, the insulating housing having a plurality of fasteners disposing at both outside thereof corresponding to the mating holes, and the fasteners engaged with the mating holes respectively.

9. The electrical card connector as claimed in claim 1, wherein the shielding member has a tab abutting against a top portion of the guide rod.

10. The electrical card connector as claimed in claim 1, wherein the shielding member further comprises a latch extending down into an inner side of the shielding member for abutting against a top margin of the guide rod.

11. The electrical card connector as claimed in claim 1, further comprises a spring switch fixed to the slider, the spring switch extended into the receiving cavity.

12. The electrical card connector as claimed in claim 1, wherein the spring switching with a L-shaped, and comprises a fixing portion and a contact portion, the fixing portion is fixed to the slider, the contact portion is retained in an inner portion of the slider and extended into the receiving cavity.

* * * * *